US009874141B2

(12) United States Patent
Bucksey

(10) Patent No.: US 9,874,141 B2
(45) Date of Patent: Jan. 23, 2018

(54) INTERNAL COMBUSTION ENGINES

(71) Applicant: COX POWERTRAIN LTD, London (GB)

(72) Inventor: Christian Bucksey, Brighton (GB)

(73) Assignee: Cox Powertrain Ltd, London (GB)

( * ) Notice: Subject to any disclaimer, the term of this patent is extended or adjusted under 35 U.S.C. 154(b) by 0 days.

(21) Appl. No.: 15/030,024

(22) PCT Filed: Oct. 16, 2014

(86) PCT No.: PCT/GB2014/053103

§ 371 (c)(1),
(2) Date: Apr. 15, 2016

(87) PCT Pub. No.: WO2015/056015

PCT Pub. Date: Apr. 23, 2015

(65) Prior Publication Data

US 2016/0252012 A1 Sep. 1, 2016

(30) Foreign Application Priority Data

Oct. 17, 2013 (GB) ..... 1318376.9
May 14, 2014 (GB) ..... 1408534.4

(51) Int. Cl.
*F01B 7/12* (2006.01)
*F02B 75/28* (2006.01)
(Continued)

(52) U.S. Cl.
CPC ..... *F02B 75/28* (2013.01); *F01B 1/08* (2013.01); *F01B 7/04* (2013.01); *F01L 1/38* (2013.01);
(Continued)

(58) Field of Classification Search
CPC ..... F02B 75/28; F02B 25/08; F02B 75/1896; F02B 75/282; F02B 75/24; F02M 61/14;
(Continued)

(56) References Cited

U.S. PATENT DOCUMENTS 1,236,472 A 8/1917 Nyquist
1,415,481 A * 5/1922 Reed ..... F02B 75/28 123/50 R
(Continued)

FOREIGN PATENT DOCUMENTS

DE 27 09 939 A1 9/1978
EP 1 295 017 B1 7/2008
(Continued)

OTHER PUBLICATIONS

International Search Report and Written Opinion of the International Searching Authority, dated Feb. 4, 2015, for corresponding International Application No. PCT/GB2014/053103, 9 pages.

*Primary Examiner* — Hung Q Nguyen
(74) *Attorney, Agent, or Firm* — Seed IP Law Group LLP

(57) ABSTRACT

An internal combustion engine comprising at least one pair of opposed, reciprocating pistons forming a combustion chamber therebetween a crankshaft driven by the pistons via respective drive linkages. The outer piston furthest from the crankshaft comprises a skirt extending from its perimeter towards the crankshaft to form a cylinder within which the other, inner piston reciprocates.

14 Claims, 3 Drawing Sheets

(51) Int. Cl.

| | |
|---|---|
| ***F01B 7/04*** | (2006.01) |
| ***F01L 1/38*** | (2006.01) |
| ***F01B 1/08*** | (2006.01) |
| ***F01L 17/00*** | (2006.01) |
| ***F01L 21/02*** | (2006.01) |
| ***F02B 75/24*** | (2006.01) |
| ***F02B 25/08*** | (2006.01) |
| ***F02B 75/18*** | (2006.01) |
| ***F02F 1/22*** | (2006.01) |
| ***F02M 61/14*** | (2006.01) |

(52) U.S. Cl.
CPC ..... *F01L 17/00* (2013.01); *F01L 21/02* (2013.01); *F02B 25/08* (2013.01); *F02B 75/1896* (2013.01); *F02B 75/24* (2013.01); *F02B 75/282* (2013.01); *F02F 1/22* (2013.01); *F02M 61/14* (2013.01)

(58) Field of Classification Search
CPC ..... F02F 1/22; F01L 1/38; F01L 1/08; F01L 17/00; F01L 21/02; F01B 7/04
See application file for complete search history.

(56) References Cited

U.S. PATENT DOCUMENTS 1,474,712 A * 11/1923 Haibe ..... F02B 75/28 123/50 R
1,528,280 A * 3/1925 Upton ..... F02B 75/28 123/50 R
1,684,293 A * 9/1928 Allan ..... F02B 75/282 123/310
1,686,794 A * 10/1928 Brugger ..... F02B 75/28 123/50 A
1,718,088 A * 6/1929 Stuver ..... F02B 75/28 123/50 R
1,817,510 A * 8/1931 Ewart ..... F02B 75/282 123/50 R
6,341,583 B1 * 1/2002 Ryu ..... F02B 75/30 123/54.4
2009/0007859 A1 * 1/2009 Gamble ..... F01B 1/08 123/41.77

FOREIGN PATENT DOCUMENTS

| | | | |
|---|---|---|---|
| GB | 7942 | A | 0/1913 |
| GB | 12561 | A | 0/1913 |
| GB | 169197 | A | 9/1921 |
| GB | 2 432 398 | A | 5/2007 |
| WO | 94/07012 | A1 | 3/1994 |
| WO | 2006/060859 | A1 | 6/2006 |
| WO | 2008/149061 | A2 | 12/2008 |
| WO | 2012/160376 | A2 | 11/2012 |
| WO | 2012/160378 | A2 | 11/2012 |

* cited by examiner

INTERNAL COMBUSTION ENGINES

FIELD OF THE INVENTION

This invention relates to internal combustion engines. More particularly it relates to internal combustion engines with an opposed piston configuration.

BACKGROUND

WO2008/149061 (Cox Powertrain) describes a 2-cylinder 2-stroke direct injection internal combustion engine. The two cylinders are horizontally opposed and in each cylinder there are opposed, reciprocating pistons that form a combustion chamber between them. The pistons drive a central crankshaft between the two cylinders. The inner piston (i.e. the piston closer to the crankshaft) in each cylinder drives the crankshaft through a pair of parallel scotch yoke mechanisms. The outer piston in each cylinder drives the crankshaft through a third scotch yoke, nested between the two scotch yoke mechanisms of the inner piston, via a drive rod that passes through the centre of the inner piston. The drive rod has a hollow tubular form and fuel is injected into the combustion chamber by a fuel injector housed within the drive rod. The wall of the drive rod has a series of circumferentially spaced apertures through which the fuel is projected laterally outwardly into the combustion chamber.

WO2012/160378 (Cox Powertrain) describes a development of the configuration of the engine described in WO2008/149061. In the engine described in this document, the outer piston of each pair of opposed pistons drives the crankshaft through a drive linkage that is external to the cylinder in which the pistons reciprocate. This avoids the need for any drive rods passing through the combustion chamber and inner piston and also means that a fuel injector can be located centrally with respect to the piston (or close to the centre of the piston) without obstruction.

SUMMARY OF THE INVENTION

The present invention is a development of the configuration of the engines described in WO2008/149061 & WO2012/160378.

The present invention provides an internal combustion engine comprising at least one pair of opposed, reciprocating pistons forming a combustion chamber therebetween, and a crankshaft driven by the pistons via respective drive linkages, the piston furthest from the crankshaft (the 'outer' piston) comprising a skirt extending from its perimeter towards the crankshaft to form a cylinder within which the other piston (the 'inner' piston closest to the crankshaft) reciprocates.

The outer piston can itself reciprocate within a cylinder or other support structure adapted to retain and guide the motion of the piston.

The outer piston skirt can serve as at least part of the drive linkage between the outer piston and the crankshaft. For example, an inner end of the skirt can be connected to or be formed integrally with the yoke element of a scotch yoke drive. The inner end of the skirt may be bifurcated to form diametrically opposed arms at the inner end of the skirt, each arm being connected to or formed integrally with the yoke of a respective scotch yoke drive spaced apart along the crankshaft.

By using the outer piston skirt as part of the drive linkage the need for any drive rods passing through the inner cylinder is avoided, as in WO2012/160378, offering many of the same benefits over WO2008/149061 as that engine does with its external drive linkage, e.g. a more straightforward, conventional combustion chamber design, elimination of a blowby path to the crankcase and the freedom to locate a fuel injector centrally with respect to the piston (or close to the centre of the piston) without obstruction. Moreover, by using the piston skirt in this way to drive the crankshaft, the current proposal also does away with the need for the external drive linkage of WO2012/160378, which potentially reduces the cost of manufacture, makes it easier to balance the engine, and makes it possible to reduce the weight and size of the engine. Moreover, with this arrangement, all (or substantially all) of the forces generated by the combustion pressure are transmitted straight the crankshaft via the pistons and their connections to the crankshaft. Unlike more conventional engines, little or no combustion pressure force is transmitted through a crankcase. This in turn means that the crankcase can have a lighter construction (e.g. thinner walls and/or lighter weight materials than conventional crankcases) as it does not need to withstand these forces.

Any suitable drive linkage may be used to translate the opposed reciprocating motion of the pistons into a rotary motion of the crankshaft. In some embodiments, scotch yoke mechanisms are used, as suggested above. Where scotch yoke mechanisms are used, as a minimum it would be necessary to have at least one scotch yoke through which the inner piston (i.e. the piston closest to the crankshaft) drives the crankshaft and at least one scotch yoke through which the outer piston drives the crankshaft. However, to avoid undesirable unbalanced forces on the outer piston, whilst avoiding the need for a central drive rod through the cylinder, it is more preferable for the outer piston to drive the crankshaft through a pair of scotch yokes connected to opposite sides of the outer piston skirt directly or through respective connection members. The connection members may, for example, be one or more drive rods.

In other embodiments, the drive linkage need not include scotch yoke mechanisms and may instead employ a more conventional crank arrangement, with cranks integrally formed in the crankshaft that are driven by the pistons, for example via one or more connecting rods or other suitable connecting links, to translate the reciprocating motion of the pistons into rotation of the crankshaft. In one example, the inner piston drives one crank on the crankshaft via a conventional connecting rod that is pivotally connected to the inner piston. In this example, the outer piston drives a pair of cranks, spaced one to either side of the inner piston crank. The outer piston drives these cranks via respective links that are pivotally connected to the inner end of the inner piston, the two links being diametrically opposed to one another on the piston.

The skirt of the reciprocating outer piston (that provides the cylinder within which the inner piston reciprocates) can also act as a sleeve valve. More specifically, inlet and exhaust ports can be formed in the skirt so that as the outer piston reciprocates these ports periodically align with corresponding inlet and exhaust ports or chambers in the surrounding structure. The position, shape and size of the ports can be configured to give a desired breathing pattern for the cylinder.

In some embodiments the outer piston is driven to rotate, for example in a reciprocal fashion (i.e. alternate clockwise and ant-clockwise rotation) about its central (longitudinal) axis as it performs its linear reciprocal cycle. This rotation of the outer piston can be used to give a greater degree of asymmetry in the inlet and exhaust port opening and closing and has also been shown to help maintain an oil lubrication film between the outer wall of the skirt of the outer piston and the surrounding structure within which it slides, as well as between the inner wall of the outer piston skirt and the side wall of the inner piston that slides within the skirt.

Whilst a single cylinder configuration is possible (i.e. one pair of opposed reciprocating pistons, with the outer piston skirt providing a cylinder for the inner piston), preferred engines in accordance with embodiments of the invention comprise multiple cylinders (i.e. multiple pairs of opposed reciprocating pistons), for example two cylinders, four cylinders, six cylinders, eight cylinders or more. In the following, the term "cylinder" is used to refer to pair of opposed reciprocating pistons, with the outer piston skirt providing a cylinder for the inner piston Where multiple cylinders are used, various configurations are possible that may offer different benefits in terms of balance of forces, overall shape and size of the engine, etc. Exemplary configurations include (but are not limited to) coaxial opposed pairs of cylinders (e.g. 'flat two', 'flat four', etc), 'straight' configurations with all of the cylinders side-by-side, 'U' configurations with two straight banks of cylinders side-by-side (e.g. 'square 4'), 'V' configurations and 'W' configurations (i.e. two adjacent banks of 'V' configured cylinders) and radial configurations. Depending on the configuration, the multiple cylinders may drive a single crankshaft or a plurality of crankshafts. Typically 'flat', 'straight', 'V' and radial configurations will have a single crankshaft, whereas 'U' and 'W' configurations will have two crankshafts, one for each bank of cylinders. In some embodiments of the invention it is possible to use two engine units (each with one or more cylinders) with contra-rotating crankshafts that drive a shared output shaft through a bevel gearbox. This arrangement has the advantage that torque recoil effects are balanced.

By using the outer piston skirt as part of the drive linkage for the outer piston, the requirement for a central drive rod for the outer piston, as used in the arrangement described in WO2008/149061, is obviated. Consequently, embodiments of the invention may comprise a fuel injector disposed on or close to the central axis of the cylinder as described in WO2012/160376, the entire contents of which are incorporated herein by reference.

As explained in WO2012/160376, the fuel injector may be fixed in position and extend through the centre of the outer piston, the outer piston being configured to reciprocate along a housing of the injector. Alternatively, the fuel injector may move with the outer piston through part of the piston's stroke or the piston's entire stroke. In the latter case, the injector may be fixed to the piston.

The injector may be fixed to an outer part of the engine structure by any suitable coupling. In some cases it may be desirable to use a coupling that allows the injector to self-align itself parallel to the centreline of the cylinder and to accommodate tolerances and thermal distortion of the piston it is associated with. For example, an Oldham coupling may be used (this type of coupling allows the injector to move in a plane perpendicular to its axis, to allow the desired alignment, whilst preventing movement along its axis).

BRIEF DESCRIPTION OF THE DRAWINGS

An embodiment of the invention is now described by way of example, with reference to the accompanying drawings in which.

DETAILED DESCRIPTION

Figure 1:
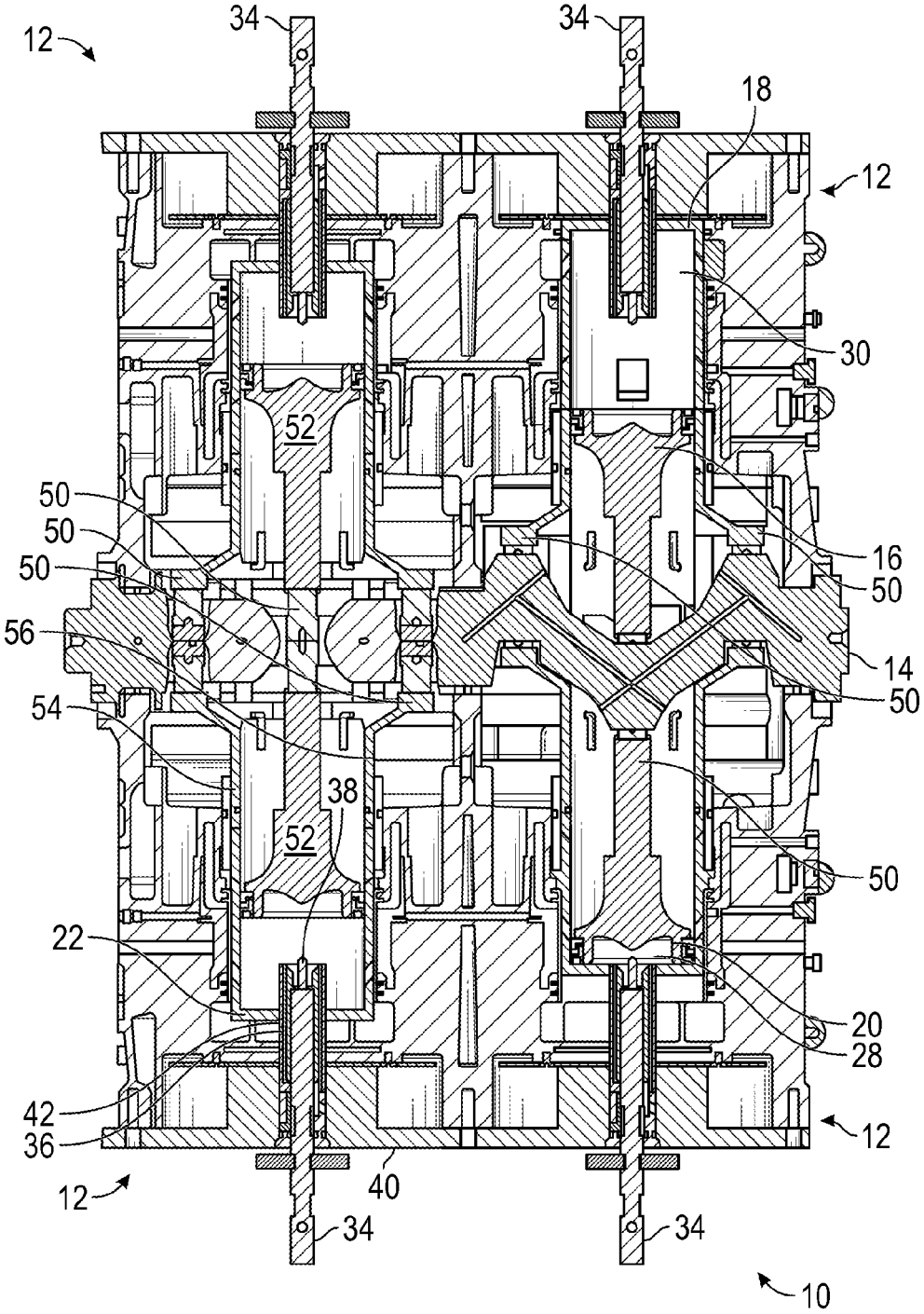
FIG. 1 is a cross-section through a flat four engine configuration according to an embodiment of the present invention.

With reference to FIG. 1, the embodiment used here to exemplify the invention is a 2-stroke, direct injection, four cylinder engine. The engine is configured with two horizontally opposed pairs of cylinders. One pair of cylinders is arranged alongside the other to give a 'flat four' configuration. This configuration provides the engine with a low-profile overall envelope that will be advantageous for some applications, for example for use as an outboard marine engine. Engines in accordance with embodiments of the invention can also be used as propulsion or power generation units for other marine applications, as well as for land vehicles and aircraft.

In more detail, the engine 10 comprises four cylinders 12 arranged about a central crankshaft 14. The two cylinders, one either side of the crankshaft, to the left of FIG. 1 are one opposed pair of cylinders and the two other cylinders, towards the right of FIG. 1 are the other pair of opposed cylinders.

Within each cylinder there are two pistons, an inner piston 16 and an outer piston 18. The two pistons in each cylinder are opposed to one another and reciprocate in opposite directions, in this example 180 degrees out of phase.

Each piston has a crown 20, 22, the crowns of the two pistons facing one another. In this example, the crown 22 of the outer piston is substantially flat whereas the crown 20 of the inner piston has an annular depression with a generally tear-drop shaped cross-section. At top dead centre, when the piston crowns are closest to one another (and very nearly touching), the opposed crowns 20, 22 define a combustion chamber (in this example a toroidal combustion chamber) 28 into which the fuel is injected.

Each outer piston 18 has a cylindrical skirt 30 that extends from the perimeter of outer piston crown 22. This skirt 30 provides a cylinder within which the inner piston 16 reciprocates and into which the air charge and fuel are delivered.

When the pistons are at a position in their cycle where their respective crowns are spaced furthest from one another to define a maximum contained volume within the cylinder ("bottom dead centre"), as seen for the top right cylinder in FIG. 1, the inner piston crown is withdrawn sufficiently far to uncover intake ports and exhaust ports, towards the inner and outer ends of the cylindrical skirt of the outer piston respectively, in this position the ports in the outer piston skirt being aligned with corresponding intake and exhaust chambers outside the piston skirt wall, for example in the cylinder block. The intake chamber may comprise a valve to prevent backflow from the cylinder.

As the pistons 16, 18 move towards one another in the compression stroke of the cycle, the ports in the outer piston skirt move out of alignment with the intake and exhaust chambers, in effect closing these ports. The size and position of the ports in the outer piston skirt may be chosen to provide appropriate timing of the 'opening' and 'closing' of the ports. The exhaust ports may have a greater axial extent (i.e. dimension in the direction of the longitudinal axis of the cylinder) than the intake ports so that the exhaust ports open sooner than and stay open longer than the intake ports, to aid scavenging of the cylinder.

Associated with each cylinder 12 is a fuel injector 34. The fuel injector 34 has a cylindrical housing 36 with an injector nozzle 38 at one end. Fuel is supplied under pressure to the nozzle, through the injector housing, in a conventional manner. The nozzle 38 projects from an end face of the injector housing 36, and has a series of apertures equally spaced around its periphery through which fuel is injected in a generally radial direction. The nozzle is opened and closed by a needle valve (not shown). When the needle valve is open fuel is injected under pressure through the apertures. The opening and closing of the needle valve can be controlled in a conventional manner. In use, the injector housing may be cooled by a supply of a coolant fluid, which may be the fuel itself or an engine coolant for example (although this may not be required in some cases).

The fuel injector 34 is mounted along the central axis of the cylinder 12. In this example, an outer end of the injector 34 is fixed to a component 40 at the outer end of the cylinder (i.e. the end of the cylinder opposite the crankshaft 14). The injector 34 extends through a central opening 42 in the outer piston crown 22 to locate the inner end of the injector, from which the nozzle 38 projects, centrally in the cylinder 12. More specifically, as seen in the bottom right cylinders in FIG. 1, when the pistons 16, 18 are at top dead centre, the nozzle 38 of the fuel injector 34 is directly within the combustion chamber 28 and fuel can be injected laterally from the nozzle 38 into the combustion chamber 28.

In the central injector arrangement described here the injector 34 is fixed in position and, during operation of the engine 10, the outer piston 18 travels along the outside of the injector housing 36. Appropriate seals are provided around the periphery of the opening 42 in the outer piston crown 22 to maintain a seal between the piston crown 22 and the injector housing 36 as the piston 18 reciprocates back and forth along the injector housing 36, to avoid or at least minimise leakage of pressurised gases from within the cylinder and to prevent ingress of oil to the combustion chamber.

The fuel injectors 34 themselves can be of conventional construction, save that the outer surface of the injector housing is configured to allow sliding contact with the piston 18. Typically the fuel spray will take the form of a plurality of radial jets spaced around a nozzle of the injector and controlled by a single valve arrangement (e.g. a needle valve arrangement comprising a needle and seat that the needle engages to close the valve).

In this example, the pistons 16, 18 drive the crankshaft 14 through six scotch yoke arrangements 50 mounted on respective eccentrics on the crankshaft 14.

In each pair of opposed cylinders, the two inner pistons 16 share a scotch yoke and the two outer pistons share a pair of scotch yokes, one to either side (along the crankshaft) of the inner piston yoke. The inner pistons drive their scotch yoke through respective central drive rods 52. The outer pistons drive their scotch yokes through arms 54,56 that extend from the inner (crankshaft) end of the outer piston skirt 30. In this example, the arms flare outwardly towards the crankshaft so that the outer piston scotch yokes are spaced outwardly to either side of the reciprocating pistons along the crankshaft.

Figure 2:
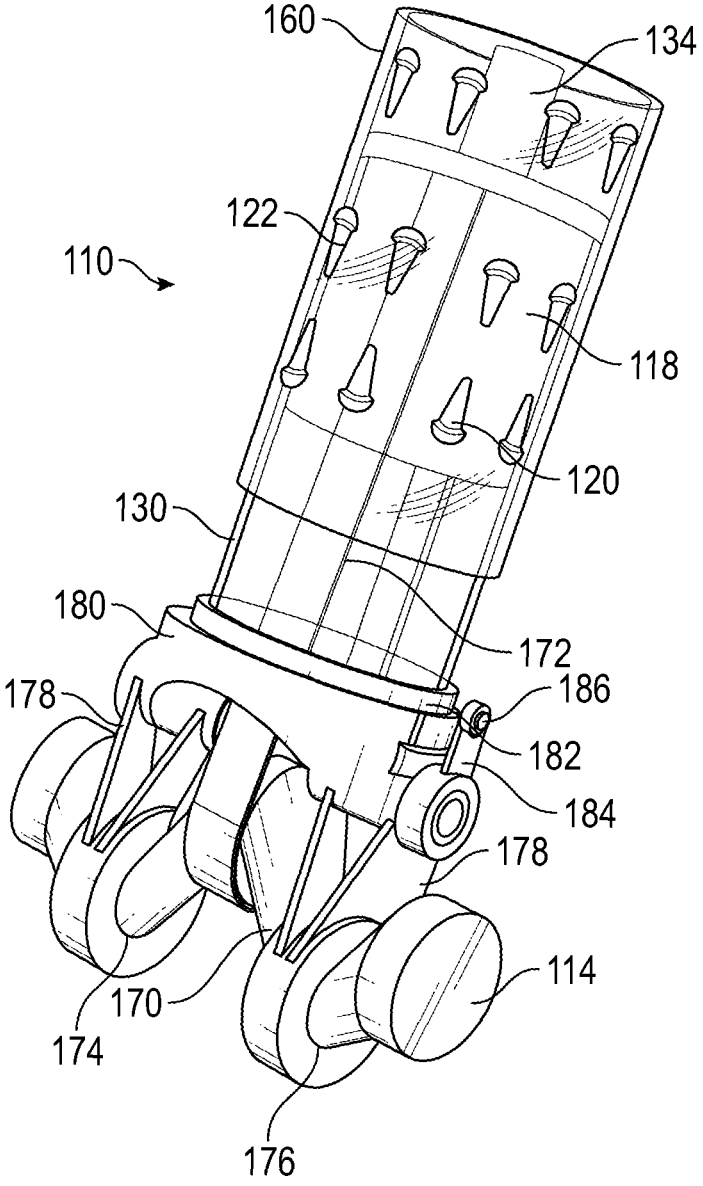
FIG. 2 shows a representation of a single cylinder in accordance with another embodiment of the invention.
Figure 3:
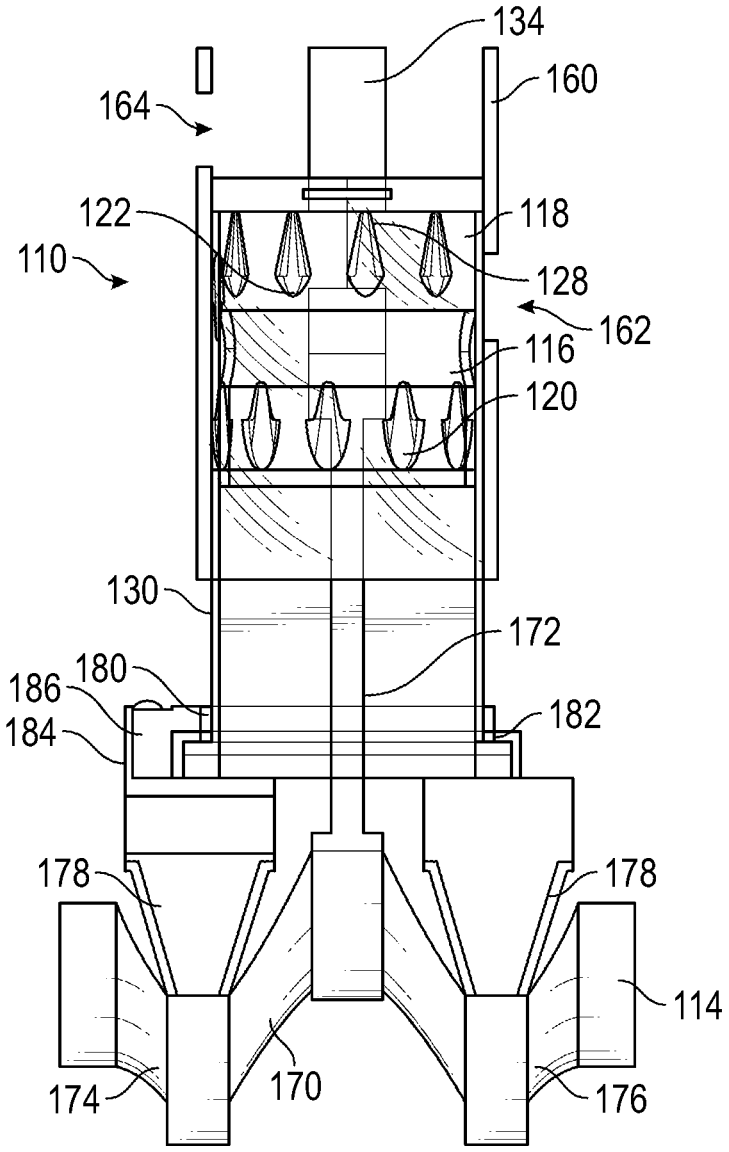
FIG. 3 shows a vertical section through the cylinder of FIG. 2.

FIGS. 2 and 3 show a single cylinder assembly 110 of another example of an engine in accordance with an embodiment of the invention. The cylinder assembly shown here can be used in a single-cylinder engine configuration or multiple cylinder assemblies of the illustrated configuration can be used in a multi-cylinder engine (e.g. with a horizontally opposed 'boxer' configuration, an in-line 'straight' configuration, a 'V' configuration, etc).

The cylinder assembly 110 comprises a pair of opposed pistons, an inner piston 116 and an outer piston 118, that reciprocate to drive a crankshaft 114. As with the example of FIG. 1, the crowns of the two pistons face one another and form a combustion chamber 128 therebetween, into which the fuel is injected.

Similarly to the example of FIG. 1, the outer piston 118 has a cylindrical skirt 130 that provides a cylinder within which the inner piston 116 reciprocates and into which the air charge and fuel are delivered. Also in common with the example of FIG. 1, the skirt has intake and exhaust ports 120, 122 formed therein, towards the inner and outer ends of the skirt respectively, that operate in a similar manner as that described above. In this example, however, as described further below, as the outer piston 118 reciprocates towards and away from the crankshaft, it also rotates about its axis in a reciprocating fashion, in one direction as the piston move towards the crankshaft 114 and back in the opposite direction as the piston moves away from the crankshaft. In this example, the cylinder assembly 110 also includes a fixed cylindrical casing 160 that surrounds the skirt 130 of the outer piston 118. This cylindrical casing 160 has a plurality of inlet and exhaust ports 162, 164 spaced circumferentially around the inner and outer ends of the casing respectively. As the outer piston 118 reciprocates (both linear and rotary) the ports 120, 122 in the outer piston skirt are periodically brought into alignment with corresponding ports 162, 164 in the casing to control the opening and closing of the ports for ingress and exhaust of gas to/from the combustion chamber between the two pistons.

The position and size of the ports in the outer piston and surrounding casing, as well as the degree of reciprocating rotary motion can be designed to give a desired pattern of opening and closing of the ports and hence a desired breathing pattern for the cylinder.

The inner piston drives the crankshaft 114 through a central crank 170, via a connecting rod 172. An inner end of the connecting rod 172 is connected by a rotary bearing to the crank 170 and an outer end of the connecting rod 172 is connected to the underside of the inner piston crown with another rotary bearing, in a conventional manner.

The outer piston drives the crankshaft 114 through a pair of cranks 174, 176, equally spaced to either side of the central crank 170. The outer piston drives these cranks 174, 176 there through respective link arms 178 that act in the same manner as a connecting rod. The two link arms are mounted by rotary bearings on the inner end of the outer piston, diametrically opposed to one another.

To enable the rotary motion of the outer piston, in this example the outer piston comprises an annular support 180 at its inner end (i.e. closest to the crankshaft. This support provides an annular bearing 182 for the inner end of the outer piston skirt 130, enabling rotation of the skirt, about the central axis of the cylinder, relative to the annular support 180.

With this configuration, the link arms 178 are mounted on this annular support 180 part of the outer piston 118. An outer end portion 184 of each link arm 178 extends beyond the rotary connection to the annular support, away from the crankshaft, so that as the arm 178 moves to and fro to drive the crank, the outer end portion (i.e. the end furthest from the crankshaft) also moves to and fro (in an opposite direction). The outer end portion 184 of each arm 178 is connected to the inner end of the skirt 130 by a ball joint 186, so that as the arm 178 moves back and forth the outer portion 184 of the arm drives the skirt back and forth in a rotary motion on its bearing 182 on the annular support 180.

The example of FIGS. 2 and 3 also includes a fuel injector 134 mounted along the central axis of the cylinder assembly 110, extending through the crown of the outer piston 118 from the outer end of the cylinder. As in the example of FIG. 1, the outer piston 118 reciprocates along the injector 134.

The skilled person will appreciate that various modification to the specifically described embodiment are possible without departing from the invention. For example, traditional connection rods may be used in place of the scotch yokes. The skilled person will appreciate that embodiments of the invention may be 2-stroke or 4-stroke and may be compression ignition or spark ignition.

The invention claimed is:

1. An internal combustion engine comprising:

at least one pair of opposed, reciprocating pistons forming a combustion chamber therebetween, the at least one pair of opposed pistons comprising an outer piston furthest from the crankshaft and an inner piston; and a crankshaft driven by the pistons via respective drive linkages;

wherein the outer piston comprises a skirt extending from its perimeter towards the crankshaft to form a cylinder within which the inner piston reciprocates;

the skirt of the outer piston comprises one or more inlet ports and one or more exhaust ports and functions as a sleeve valve to enable ingress and exhaust of gases from the combustion chamber as the pistons reciprocate; and the outer piston is driven to rotate about its central axis as it reciprocates towards and away from the inner piston.

2. An internal combustion engine according to claim 1, wherein outer piston skirt serves as at least part of the drive linkage between the outer piston and the crankshaft.

3. An internal combustion engine according to claim 2, comprising at least one scotch yoke through which the inner piston drives the crankshaft and at least two scotch yokes spaced apart along the crankshaft, through which the outer piston drives the crankshaft via the outer piston skirt.

4. An internal combustion engine according to claim 2, comprising at least one crank through which the inner piston drives the crankshaft and at least two cranks spaces apart along the crankshaft, one to either side of the inner piston crank, through which the outer piston drives the crankshaft.

5. An internal combustion engine according to claim 1, wherein said rotary motion is a reciprocating rotary motion.

6. An internal combustion engine according to claim 1 comprising multiple pairs of opposed, reciprocating pistons, each pair forming a combustion chamber therebetween.

7. An internal combustion engine according claim 1 comprising at least one fuel injector disposed on or parallel to a central axis of the cylinder formed by the outer piston skirt.

8. An internal combustion engine according to claim 7, wherein the fuel injector projects from one end of the cylinder, through one of the pistons, and as said piston reciprocates it slides along the fuel injector.

9. An internal combustion engine comprising:

at least one pair of opposed, reciprocating pistons forming a combustion chamber therebetween, the at least one pair of opposed pistons comprising an outer piston furthest from the crankshaft and an inner piston; and a crankshaft driven by the pistons via respective drive linkages;

wherein the outer piston comprises a skirt extending from its perimeter towards the crankshaft to form a cylinder within which the inner piston reciprocates;

the engine further comprising at least one fuel injector disposed on or parallel to a central axis of the cylinder formed by the outer piston skirt.

10. An internal combustion engine according to claim 9, wherein the fuel injector projects from one end of the cylinder, through one of the pistons, and as said piston reciprocates it slides along the fuel injector.

11. An internal combustion engine according to claim 9, wherein outer piston skirt serves as at least part of the drive linkage between the outer piston and the crankshaft.

12. An internal combustion engine according to claim 11, comprising at least one scotch yoke through which the inner piston drives the crankshaft and at least two scotch yokes spaced apart along the crankshaft, through which the outer piston drives the crankshaft via the outer piston skirt.

13. An internal combustion engine according to claim 11, comprising at least one crank through which the inner piston drives the crankshaft and at least two cranks spaces apart along the crankshaft, one to either side of the inner piston crank, through which the outer piston drives the crankshaft.

14. An internal combustion engine according to claim 9 comprising multiple pairs of opposed, reciprocating pistons, each pair forming a combustion chamber therebetween.

* * * * *